US006739215B2

(12) United States Patent
Lozeau et al.

(10) Patent No.: US 6,739,215 B2
(45) Date of Patent: May 25, 2004

(54) CORK EXTRACTING DEVICE

(75) Inventors: Kevin R. Lozeau, Ridge, NY (US); Richard C. Shonfeld, Normandy (FR)

(73) Assignee: WKI Holding Company, Inc., Reston, VA (US)

( * ) Notice: Subject to any disclaimer, the term of this patent is extended or adjusted under 35 U.S.C. 154(b) by 93 days.

(21) Appl. No.: 10/108,576

(22) Filed: Mar. 28, 2002

(65) Prior Publication Data

US 2002/0152846 A1 Oct. 24, 2002

Related U.S. Application Data

(60) Provisional application No. 60/280,080, filed on Mar. 30, 2001.

(51) Int. Cl.[7] ..... B67B 7/44
(52) U.S. Cl. ..... 81/3.09; 7/155; 81/3.29
(58) Field of Search ..... 7/155; 81/3.09, 81/3.29, 3.48

(56) References Cited

U.S. PATENT DOCUMENTS

| | | | |
|---|---|---|---|
| 2,342,156 | A | 8/1944 | Miller |
| 2,522,219 | A | 6/1950 | Gaeta |
| 2,718,692 | A | 9/1955 | Krzanowski |
| 4,727,779 | A | 3/1988 | Lee |
| 4,800,784 | A | 1/1989 | Allen |
| 4,845,844 | A | 7/1989 | Allen |
| 5,351,579 | A | 10/1994 | Metz et al. |
| 5,363,725 | A | 11/1994 | Cellini |
| 5,367,923 | A | 11/1994 | Fabbro |
| 5,372,054 | A | 12/1994 | Federighi, Sr. |
| 5,653,023 | A | 8/1997 | Andina |
| D397,010 | S | 8/1998 | Usbeck |
| D404,987 | S | 2/1999 | Larimer |
| 5,887,305 | A | 3/1999 | Cellini |
| 6,079,298 | A | 6/2000 | Gasperi et al. |
| 6,151,992 | A | 11/2000 | Larimer |
| 6,196,086 | B1 | 3/2001 | Gort-Barten |

FOREIGN PATENT DOCUMENTS

| | | |
|---|---|---|
| FR | 446737 | 12/1912 |

*Primary Examiner*—James G. Smith
(74) *Attorney, Agent, or Firm*—Seyfarth Shaw LLP

(57) ABSTRACT

A cork extracting device includes a bifurcated body defining a pair of depending legs. Circumferentially spaced ribs project laterally from each leg to define guide surfaces for an extracted cork, the lower ends of the ribs defining two different-sized bottle neck seats. An oblong handle with an elastomeric covering is fixed to one end of a worm which extends through a collar in the upper end of the body and downwardly between the legs. Flexible and resilient fingers are cut from each leg and respectively carry foil cutters, the fingers being manually depressible to engage the cutters with a bottle neck foil for cutting the foil in response to rotation of the body about the bottle neck.

7 Claims, 5 Drawing Sheets

CORK EXTRACTING DEVICE

RELATED APPLICATION

This application claims the benefit of the filing date of copending U.S. Provisional Application No. 60/280,080, filed Mar. 30, 2001.

Background

This application relates to hand-operated utensils and, in particular, relates to utensils which assist in opening containers, such as bottles or the like. The application relates in particular to utensils in the nature of cork extracting devices for opening bottles, such as wine bottles, of the type which are closed with a cork.

Corkscrews are well known and a wide variety of corkscrews and utensils including corkscrews have heretofore been provided. However, many such devices are difficult and/or uncomfortable to use. Many devices provide no effective means for properly centering a corkscrew relative to the associated cork to be removed and many prior devices are uncomfortable to use, particularly for persons suffering with arthritis or the like. Also, many prior devices are not well suited for opening bottles of the type wherein the cork and bottle neck are covered with a foil wrapper or the like, providing no effective means to facilitate removal of the foil. Furthermore, prior cork extracting devices of the type which have a receptacle designed to receive the end of the bottle neck therein, have not heretofore been easily adaptable for use with different sizes or styles of bottle necks.

SUMMARY

This application discloses a cork extracting device which avoids the disadvantages of prior such devices while affording additional structural and operating advantages.

An important aspect is the provision of a cork extracting device which is readily adaptable for receiving different size bottle necks therein.

A still further aspect is the provision of a device of the type set forth, which is easy and comfortable to use.

Another aspect is the provision of a cork extracting device which facilitates centering on the neck of a closed bottle to be opened.

A still further aspect is the provision of a device of the type set forth, which facilitates removal of the foil wrapper of a corked wine bottle.

BRIEF DESCRIPTION OF THE DRAWINGS

For the purpose of facilitating an understanding of the subject matter sought to be protected, there is illustrated in the accompanying drawings an embodiment thereof, from an inspection of which, when considered in connection with the following description, the subject matter sought to be protected, its construction and operation, and many of its advantages should be readily understood and appreciated.

DETAILED DESCRIPTION

Figure 6:
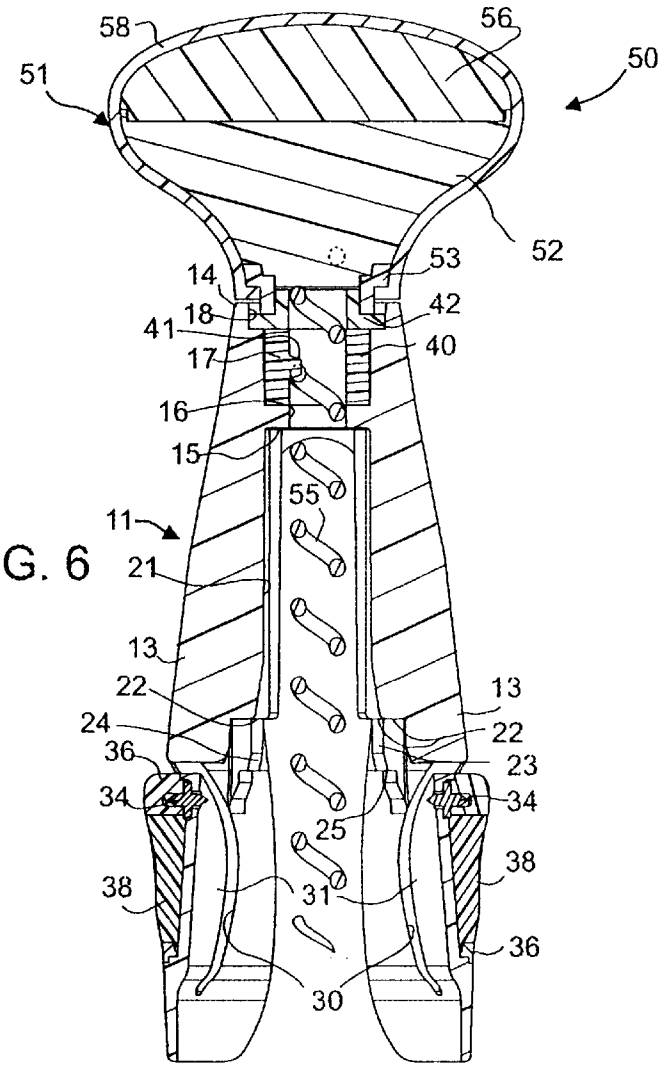
FIG. 6 is a sectional view taken generally along the line 6—6 in FIG. 4.
Figure 5:
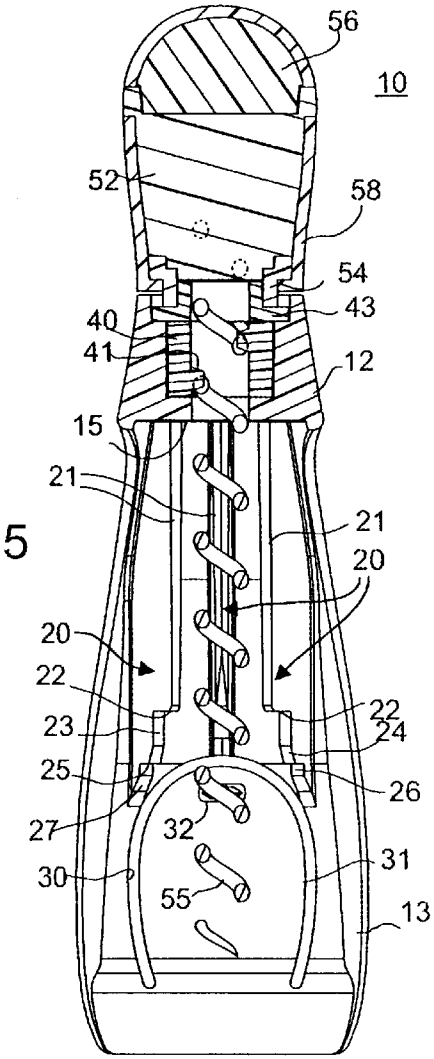
FIG. 5 is a sectional view taken generally along the line 5—5 in FIG. 3.
Figure 9:
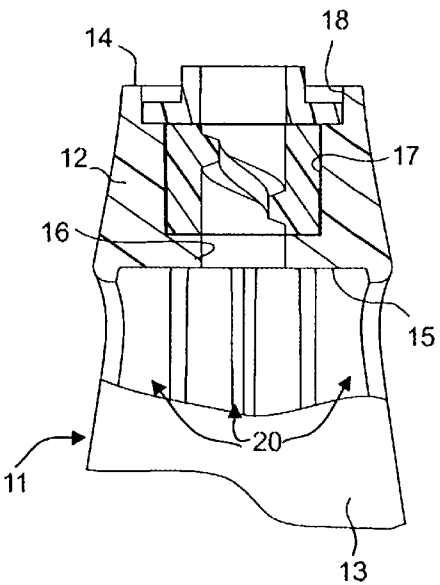
FIG. 9 is an enlarged, fragmentary, sectional view of the upper portion of the assembled body of FIG. 2.
Figure 8:
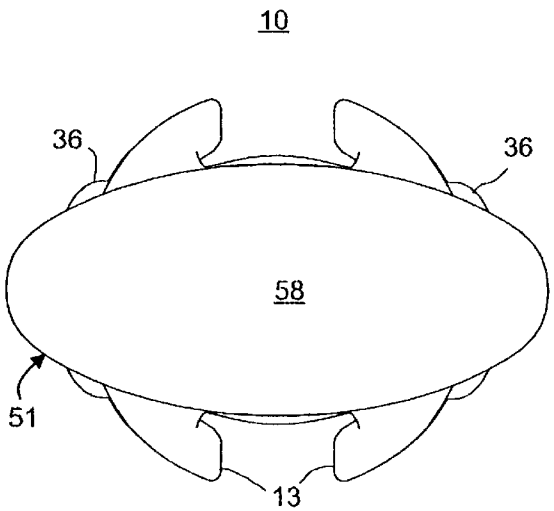
FIG. 8 is an enlarged top plan view of the device of FIG. 3.

Referring to FIGS. 1–4, there is illustrated a cork extracting device generally designated by the numeral 10, which includes an elongated body 11, which may be formed of a suitable plastic material. The body 11 has a generally cylindrical hub 12 at one end thereof, the lower end of the body 11 being bifurcated to form a pair of elongated, spaced-apart legs 13, which are formed as mirror images of each other. Each leg 13 is generally part-cylindrical in shape, having a convex outer surface and a concave inner surface. Referring also to FIGS. 5, 6 and 9, the hub 12 has an upper end surface 14 and a lower or inner end surface 15 disposed adjacent to the upper ends of the legs 13. Formed axially through the hub 12, from the upper end surface 14 to the lower end surface 15, is a cylindrical bore 16 having a first counterbore 17 and a second counterbore 18.

Figure 7:
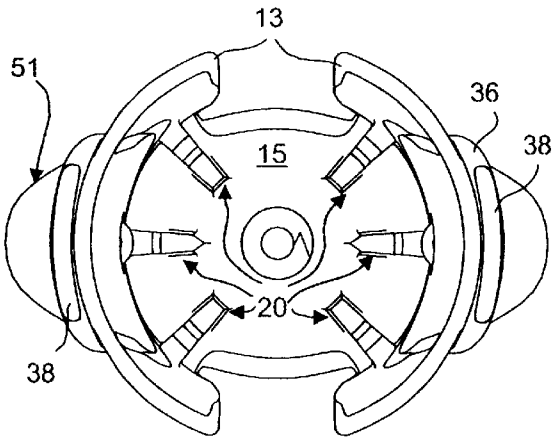
FIG. 7 is an enlarged bottom plan view of the device of FIG. 3.

Referring also to FIG. 7, formed on the inner surface of each of the legs 13, intermediate the ends thereof, are three radially inwardly projecting and longitudinally extending retention ribs 20, which are substantially equiangularly spaced apart. The inner edge of each rib 20 defines an elongated guide surface 21 disposed substantially parallel to the longitudinal axis the body 11, so that the guide surfaces 21 lie substantially along a common imaginary cylinder dimensioned to receive therein and guide there along a cork of an associated bottleneck, as will be explained more fully below. Extending radially outwardly from the guide surface 21 of each rib 20 adjacent to the lower end thereof is a shoulder 22, the shoulders 22 lying in a common plane perpendicular to the longitudinal axis of the body 11 and cooperating to define a seat structure for an associated bottle neck. Depending from the outer edge of each shoulder 22 is a substantially vertical surface 23 which joins at its lower end with a guide surface 24 which slopes radially outwardly and axially toward the distal end of the associated leg 13. Each guide surface 24, in turn, joins at its lower end with a further radially outwardly extending shoulder 25. The shoulders 25 on the several ribs 20 lie in a common plane perpendicular to the longitudinal axis of the body 11 and cooperate to define another seat structure for an associated bottle neck. Depending from the outer edge of each shoulder 25 is a short vertical surface 26 which, at its lower edge, joins a guide surface 27 which slopes radially outwardly and axially toward the distal end of the associated leg 13 and merges into the inner surface of the associated leg 13.

Figure 2:
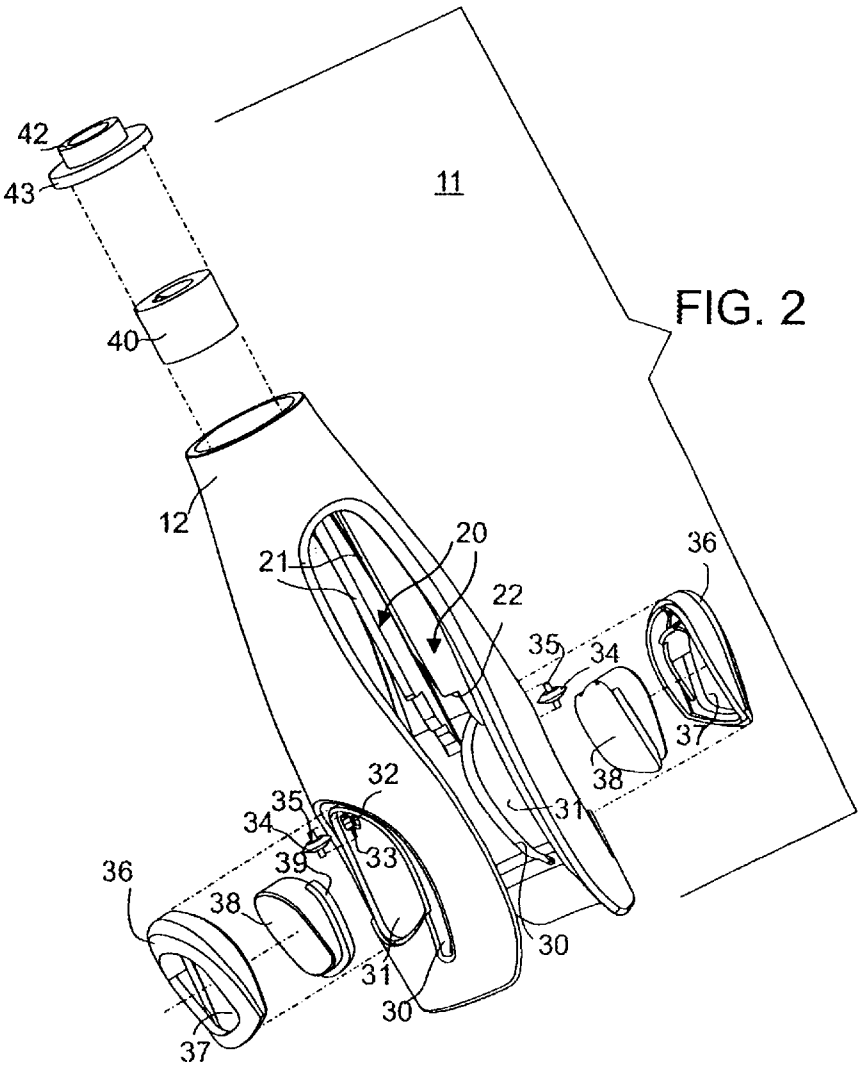
FIG. 2 is a slightly reduced, exploded, perspective view of the body portion of the device of FIG.1.
Figure 1:
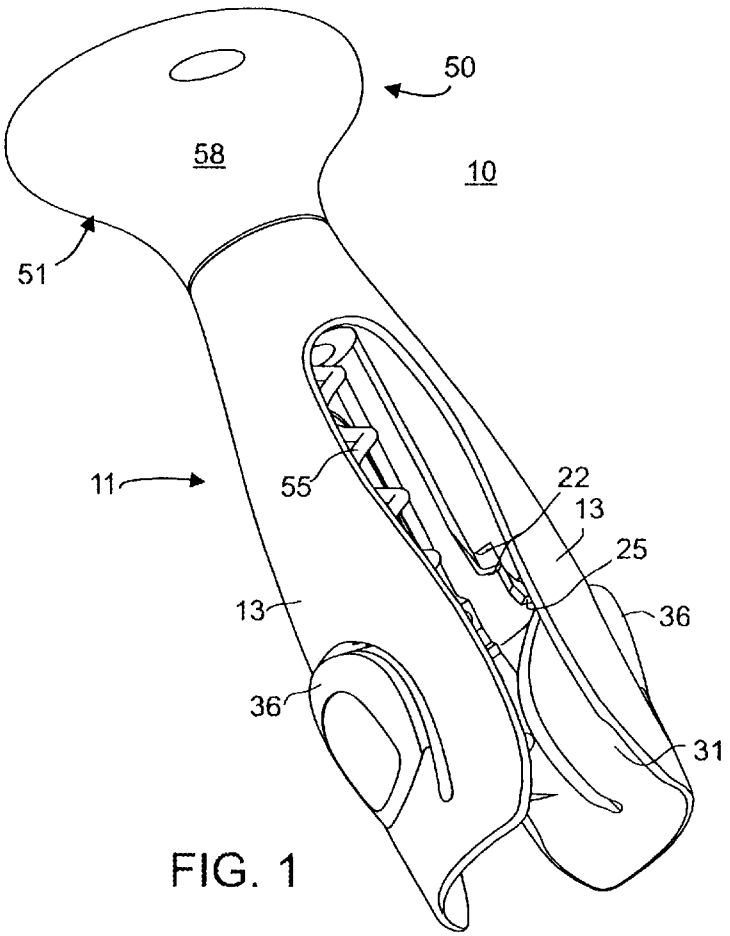
FIG. 1 is a perspective view of a cork extracting device.
Figure 4:
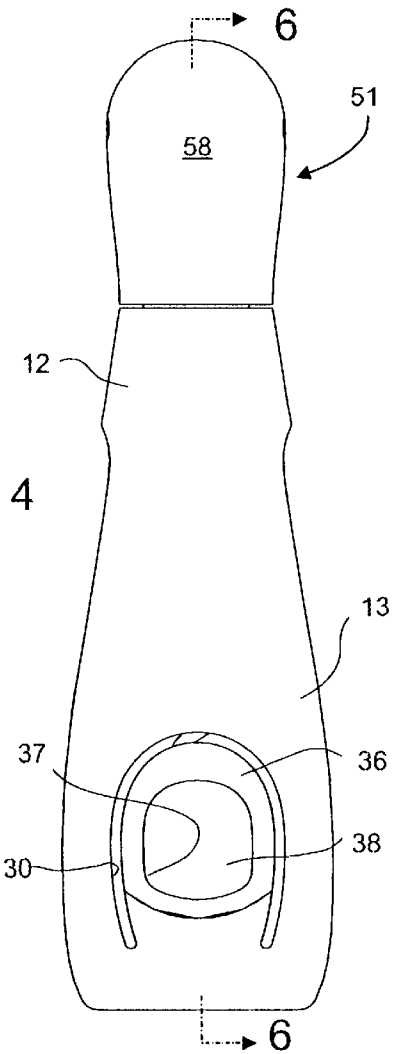
FIG. 4 is a side elevational view of the device of FIG. 3, as viewed from the right-hand side thereof.
Figure 3:
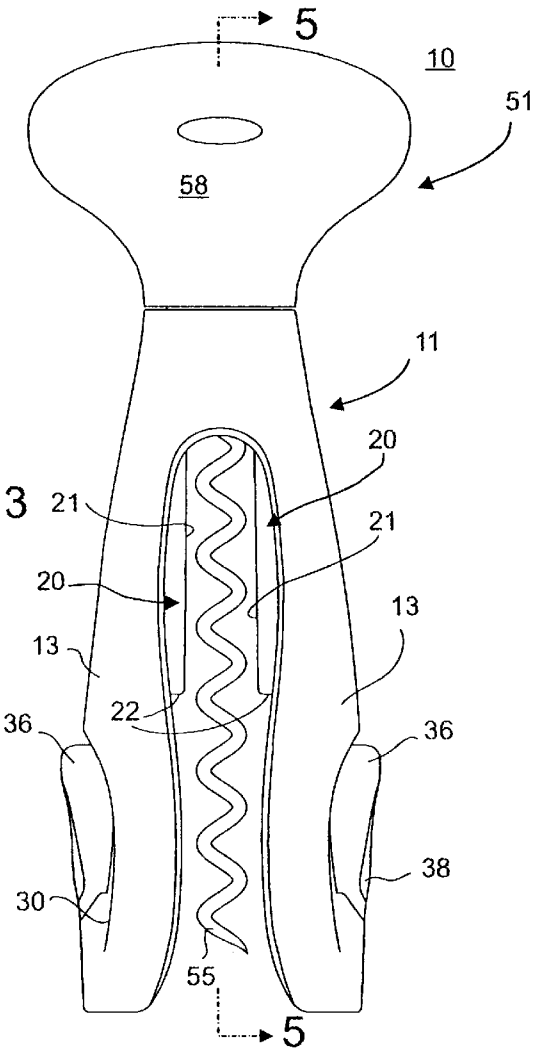
FIG. 3 is a front elevational view of the device of FIG. 1.

Formed through each leg 13 adjacent to the distal end thereof is a generally horseshoe-shaped slot 30, which defines a finger 31 hingedly connected to the remainder of the leg 13 at the lower end of the slot 30 to facilitate flexing of the finger 31 resiliently radially inwardly and outwardly. Formed through the finger 31 adjacent to the upper end thereof is a rectangular aperture 32 communicating with short upwardly and downwardly extending rectangular recesses 33 centrally thereof (see FIG. 2). Disposed in each aperture 32 is a cutter disc 34 having a vertically extending axle 35, the ends of which are respectively disposed in the recesses 33. Referring in particular to FIGS. 2 and 6, each of the fingers 31 is provided with a cover 36 having an aperture 37 formed therethrough, in which is received a pad 38 having a laterally outwardly extending flange 39 which engages the inner surface of the cover 36 to limit the depth of insertion in the aperture 37. The cover is fixedly secured to the associated finger 31, serving to hold the associated pad 38 against the outer surface of the finger 31 and also retaining the cutter disc 34 in place for rotational movement about its axle 35. The cover 36 may be held in place by ultrasonic welding.

Referring to FIGS. 4–6 and 9, seated in the counterbore 17 of the hub 12 is a cylindrical bushing 40 having a bore therethrough which is coaxial with and of the same diameter of the bore 16. Formed on the inner surface of the bushing 40 is a section of a helical screw thread 41. The bushing 40 extends axially the entire depth of the counterbore 17. Seated in the counterbore 18 is an annular collar 42 having at the lower end thereof a laterally outwardly extending annular flange 43 which may be secured to the body 11, as by ultrasonic welding, for retaining the bushing 40 in place.

Referring in particular to FIGS. 1 and 3–6, the cork extracting device 10 also includes a corkscrew assembly 50, which includes a two-part handle assembly 51 and a worm 55. The handle assembly 51 includes a base portion 52, the upper end of which is oval in transverse cross section perpendicular to the axis of the body 11, while the lower end thereof defines a neck portion generally circular in transverse cross section. Fixedly secured to the base portion 52 at its lower end is an annular collar 53 having a depending cylindrical neck 54 which is dimensioned to telescopically receive therein the collar 42. The worm 55 is fixedly secured to the base portion 52, and, more specifically, the base portion 52 may be molded around the upper end of the worm 55. The handle assembly 51 also has a top portion 56 which interfits against the upper end of the base portion 52, as by snap fitting. The entire handle assembly 51 is overmolded with a covering 58, which may be formed of a suitable elastomeric material, such as that sold under the trademark SANTOPRENE. The covering 58 extends over the entire outer surface of the handle assembly 51, with only the lower end of the neck 54 projecting therefrom. The worm 55 has a pitch equal to that of the screw thread 41 and fits down through the bushing 40 and the collar 42, being threadedly engageable with the screw thread 41. The handle assembly 51 is freely rotatable about the axis of the worm 54 relative to the body 11 for moving the corkscrew assembly 50 axially upwardly and downwardly relative to the body 11. It will be appreciated that the bushing 40 and the collar 42 accurately center the worm 55 between the legs 13.

Figure 10:
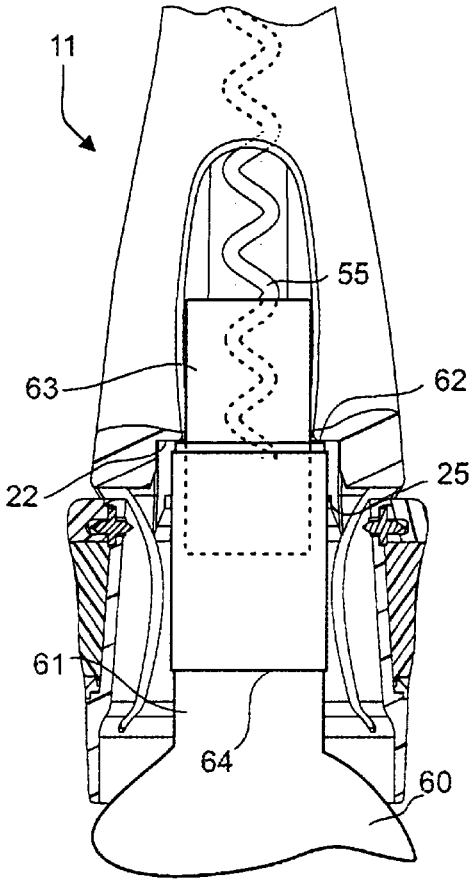
FIGS. 10 and 11 are enlarged, fragmentary views of the lower end of FIG. 6, illustrating use of the device on two different types of wine bottles.
Figure 11:
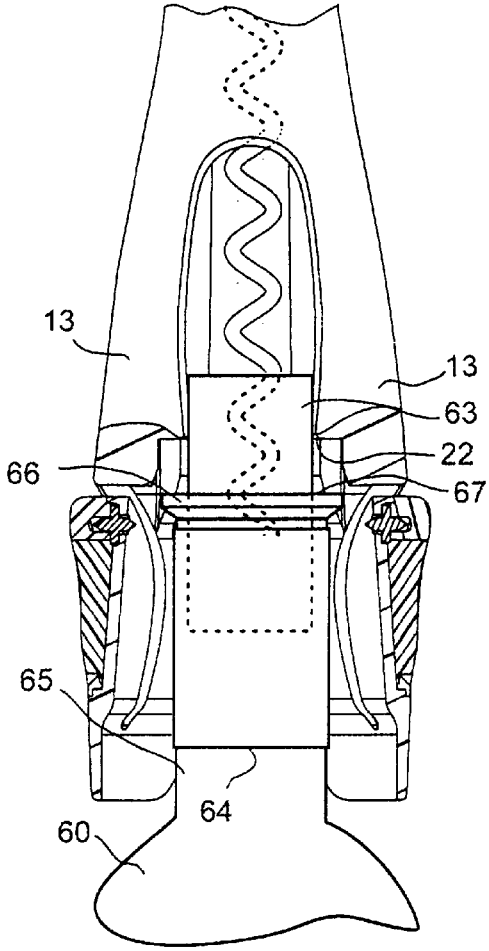

Referring now also to FIGS. 10 and 11, the operation of the cork extracting device 10 will be described. Referring to FIG. 10, the use of the device will be illustrated in connection with a first type of wine bottle 60 having a neck 61 with an annular end surface 62 closed by a cork 63 and covered with a foil 64. The cork extracting device 10 is fitted over the neck 61 of the bottle 60, with the legs 13 straddling the neck 61. If the cork extracting device 10 is in the configuration illustrated in FIGS. 1 and 3 with the handle assembly 51 disposed against the upper end of the body 11, the body 11 is inserted over the neck of the bottle until the pointed tip of the worm 55 engages the foil covering over the cork. Downward pressure may be exerted to pierce the covering and then the handle assembly 51 is rotated to drive the worm 55 into the cork in a known manner. Initially, the entire cork extracting device 10 moves downwardly with the worm 55 until the covered end surface 62 of the bottle neck 61 seats against the seat structure defined by the shoulders 22, shown in FIG. 10. In this regard, the neck 61 will be guided into the seating position by the sloping guide surfaces 24. Once the bottle neck 61 is seated on the shoulders 22, the body 11 cannot move further downwardly relative to the bottle 60, so continued rotation of the worm 55 will draw the cork 63 upwardly between the legs 13, being guided by the vertical guide surfaces 21, with the cork 63 breaking through the top of the foil covering 64 until the cork 63 bottoms against the inner end surface 15 of the body 11 or clear the neck 61. If it has not cleared the neck 61, it will be sufficiently extending therefrom to make removal relatively easy by pulling upwardly on the handle assembly 51. Alternatively, the handle assembly 51 may initially be screwed upwardly from the body 11 until the tip of the worm 54 is disposed above the level of the seat structures on the body 11. In this case, the body 11 is fitted over the bottle neck until the covered end surface 62 of the bottle neck 61 seats against the seat structure defined by the shoulders 22, and then the worm 55 is screwed downwardly through the cork 63 until the handle assembly 51 bottoms on the upper end of the body 11, whereupon cork extraction continues, as described above.

The cutter assembly defined by the cutter discs 34 may be used to cut the foil covering 64 to facilitate removal of the upper, broken portion thereof. In this regard, when the covered end surface 62 of the neck 61 is seated on the shoulders 22, the pads 38 of the fingers 31 may be depressed radially inwardly, as with an index finger and thumb, so that the cutter discs 34 pierce the sides of the foil covering 64. Then, the body 11 and the bottle 60 are rotated relative to each other in opposite directions about the longitudinal axis of the bottle for cutting the foil 64 around the entire circumference of the neck 61, so that the upper part of the foil 64 may be easily removed from the neck, leaving no loose or hanging shards. This is preferably done before cork extraction, so that as the cork is extracted, it pulls the severed top portion of the foil off the bottle neck.

FIG. 11 illustrates operation of the cork extracting device 10 with a bottle having a different-sized neck 64 with a laterally outwardly extending flange 66 at one end thereof to provide an enlarged-diameter end surface 67. The operation is substantially the same as was explained above with respect to FIG. 10, except that in this case, the end surface 67 of the bottle neck 65 seats against the seat structure defined by the shoulders 25, being guided to this seating engagement by the sloping guide surfaces 27.

As can be seen, the handle assembly 51 has a generally oblong, ovoid shape at the upper end thereof, cooperating with the more cylindrical lower end or neck portion to define a pair of lobes beneath which fingers of a user's hand may be wrapped to facilitate pulling a cork from a bottle neck. Also, the ovoid, bulbous shape of the handle provides a comfortable ergonomic shape which is easy to grasp and rotate in use, the elastomeric covering 58 providing a particularly comfortable grip, which is both cushioned and non-slip in nature.

While, in the illustrated embodiment, the body 11 has two depending legs, it will be appreciated that a different number of legs could be provided. Also, while three of the ribs 20 have been described as formed on each of the legs 13, it will be appreciated that a different number of ribs could be used.

From the foregoing, it can be seen that there has been provided an improved cork extracting device which is of simple and economical construction, provides effective and accurate centering over an associated bottle neck, is comfortable and easy to use, provides effective and simple foil cutting in combination with cork extraction, and is readily adapted for use with different-sized bottle necks.

The matter set forth in the foregoing description and accompanying drawings is offered by way of illustration only and not as a limitation. While a particular embodiment has been shown and described, it will be apparent to those skilled in the art that changes and modifications may be made without departing from the broader aspects of applicants' contribution. The actual scope of the protection sought is intended to be defined in the following claims when viewed in their proper perspective based on the prior art.

What is claimed is:

1. Apparatus for extracting corks from different-sized bottle necks having end surfaces, the apparatus comprising:

a body having a bottle neck-receiving portion including plural circumferentially spaced members, each member having a first shoulder thereon so that the first shoulders cooperate to form a first bottle neck seating structure shaped and dimensioned for engaging the end surface of a bottle neck of a first size without engaging a cork closing the bottle neck, each member having a second shoulder thereon so that the second shoulders cooperate to form a second bottle neck seating structure shaped and dimensioned for engaging the end surface of a bottle neck of a second size without engaging a cork closing the bottle neck, each of the members including a rib disposed on the body and projecting laterally inwardly therefrom, the lower ends of the ribs defining the first and second seating structures and the upper ends of the ribs defining guide surfaces for a cork being extracted from an associated bottle neck, and a corkscrew assembly including a handle and a worm and carried by the body for rotation relative thereto for screwing the worm into a cork closing a bottle neck when the bottle neck and surface is engaged with one of the seating structures.

2. The apparatus of claim 1, wherein each of the first and second seating structures includes six seating shoulders.

3. The apparatus of claim 2, wherein the six shoulders include three shoulders on each of two opposed sides of the bottle neck-receiving portion.

4. The apparatus of claim 1, wherein the first seating structure defines a seat for a bottle neck end surface having a first diameter and the second seating structure defines a seat for a second bottle neck end surface having a second diameter less than the first diameter.

5. Apparatus for extracting a cork from a bottle neck covered by a foil and having a central axis, the apparatus comprising:

a body having spaced-apart depending legs cooperating to define a bottle neck-receiving portion having an axis, each of the legs including a flexible and resilient finger cut therefrom and movable relative to the rest of the body, a corkscrew assembly including a worm movable along the axis for removing a cork from a bottle neck disposed along the axis in the bottle neck-receiving portion, and a foil cutting assembly including cutters respectively carried by the fingers for movement relative to the legs toward and away from a bottle neck disposed in the bottle neck-receiving portion, each cutter engageable with a foil covering a bottle neck disposed along the axis in the bottle neck-receiving portion for cutting the foil in response to rotation of the body relative to the bottle neck about the axis.

6. The apparatus of claim 5, wherein the body includes two depending legs.

7. The apparatus of claim 5, wherein each cutter includes a disk-like cutter mounted for rotation about an axis substantially parallel to the axis of the bottle neck-receiving portion.

* * * * *